US010960265B2

(12) United States Patent
Florenzano et al.

(10) Patent No.: US 10,960,265 B2
(45) Date of Patent: Mar. 30, 2021

(54) GYMNASTIC MACHINE PROVIDED WITH A DATA DETECTING SYSTEM, DATA DETECTION SYSTEM AND, METHOD OF OPERATION THEREOF

(71) Applicant: Technogym S.P.A, Cesena (IT)

(72) Inventors: Guido Florenzano, Cesena (IT); Simone Cicognani, Cesena (IT); Paolo Panichelli, Cesena (IT); Fabrizio Belloni, Cesena (IT)

(73) Assignee: Technogym S.P.A, Cesena (IT)

( * ) Notice: Subject to any disclaimer, the term of this patent is extended or adjusted under 35 U.S.C. 154(b) by 181 days.

(21) Appl. No.: 15/810,157

(22) Filed: Nov. 13, 2017

(65) Prior Publication Data

US 2018/0133550 A1 May 17, 2018

(30) Foreign Application Priority Data

Nov. 11, 2016 (IT) ..... 102016000114258

(51) Int. Cl.
*A63B 24/00* (2006.01)
*A63B 21/06* (2006.01)
(Continued)

(52) U.S. Cl.
CPC ..... *A63B 24/0062* (2013.01); *A63B 21/00* (2013.01); *A63B 21/0615* (2013.01);
(Continued)

(58) Field of Classification Search
CPC ..... A63B 24/0062; A63B 23/1281; A63B 23/1209; A63B 21/4047; A63B 21/4035;
(Continued)

(56) References Cited

U.S. PATENT DOCUMENTS

2007/0225136 A1 9/2007 Roman et al.
2008/0248926 A1 10/2008 Cole et al.
(Continued)

FOREIGN PATENT DOCUMENTS

| | | |
|---|---|---|
| DE | 102011110177 | 2/2013 |
| DE | 102014223435 | 5/2016 |
| WO | WO 00/57387 | 9/2000 |

OTHER PUBLICATIONS

Rapporto di Ricerca e Opinione Scritta [Search Report and Written Opinion] dated Jun. 28, 2017 From the Ministero Della Sviluppo Economico, Direzione Generale Produttivo e Competitivita, Ufficio Italiano Brevette e Marchi Re. Application No. IT201600114258. (7 Pages).

*Primary Examiner* — Joshua Lee
*Assistant Examiner* — Shila Jalalzadeh Abyaneh

(57) ABSTRACT

The present invention relates to a gymnastic machine (M) for carrying out strength exercises by a user comprising a support frame (1), at least one arm (2), movable with respect to said support frame (1), to carry out a gymnastic exercise by said user, wherein said at least one arm (2) comprises a first end (21), rotatably coupled with said support frame (1), and wherein on said at least one arm (2) a plurality of weights (7) can be removably applied, at least one detecting system (S) for detecting the displacement of said at least one arm (2) with respect to said support frame (1), comprising at least one magnetic element (12), at least one magnetic sensor (11), for detecting the magnetic field generated by said magnetic element (12), capable of generating an electric signal related to said detected magnetic field, and a control logic unit (13), operatively connected to said magnetic sensor (11), for acquiring and processing said electric signal related to said detected magnetic field.
The present invention also relates to a system (S) applicable to said exercise machine (M).
(Continued)

The present invention also relates to a method of operation of said exercise machine (M).

15 Claims, 6 Drawing Sheets

(51) Int. Cl.

| | |
|---|---|
| ***A63B 23/035*** | (2006.01) |
| ***A63B 21/00*** | (2006.01) |
| ***A63B 71/06*** | (2006.01) |
| ***A63B 23/12*** | (2006.01) |
| *A63B 71/00* | (2006.01) |
| *A63B 71/02* | (2006.01) |

(52) U.S. Cl.
CPC ..... *A63B 21/159* (2013.01); *A63B 21/4035* (2015.10); *A63B 21/4047* (2015.10); *A63B 23/03516* (2013.01); *A63B 23/1209* (2013.01); *A63B 23/1281* (2013.01); *A63B 71/0622* (2013.01); *A63B 21/0616* (2015.10); *A63B 23/1236* (2013.01); *A63B 2071/0072* (2013.01); *A63B 2071/025* (2013.01); *A63B 2208/0233* (2013.01); *A63B 2220/13* (2013.01); *A63B 2220/16* (2013.01); *A63B 2220/24* (2013.01); *A63B 2220/51* (2013.01); *A63B 2220/52* (2013.01); *A63B 2220/62* (2013.01); *A63B 2220/833* (2013.01); *A63B 2220/89* (2013.01)

(58) Field of Classification Search
CPC ..... A63B 21/159; A63B 23/03516; A63B 71/0622; A63B 21/0615; A63B 2220/16; A63B 2071/025; A63B 21/0616; A63B 2220/833; A63B 2220/13; A63B 2071/0072; A63B 23/1236; A63B 2220/89; A63B 2220/52; A63B 2220/62; A63B 2220/51; A63B 2220/24; A63B 2208/0233; A63B 2220/36; A63B 2220/20; A63B 2220/17; A63B 2220/18; A63B 2220/58; A63B 2220/80; A63B 2220/83; A63B 22/0048; A63B 21/06; A63B 21/05; A63B 21/028; A63B 21/0604; A63B 21/0632
See application file for complete search history.

(56) References Cited

U.S. PATENT DOCUMENTS

2013/0310235 A1* 11/2013 Carr ..... A63B 26/003 482/145
2014/0256516 A1* 9/2014 Calderone ..... A63B 23/03525 482/98

* cited by examiner

GYMNASTIC MACHINE PROVIDED WITH A DATA DETECTING SYSTEM, DATA DETECTION SYSTEM AND, METHOD OF OPERATION THEREOF

RELATED APPLICATION

This application claims the benefit of priority of Italian Patent Application No. 102016000114258 filed Nov. 11, 2016, the contents of which are incorporated herein by reference in their entirety.

FIELD AND BACKGROUND OF THE INVENTION

The present invention relates to a gymnastic machine provided with a data detecting system.

The present invention also relates to a data detection system.

The present invention also relates to the method of operation of the gymnastic machine.

More specifically, the invention relates to a gymnastics machine of the said type, designed and realized in particular for performing gymnastic exercises for strengthening the musculature, and in particular biceps, quadriceps, dorsal, pectoral, triceps and deltoids, to enable a user, who carries out such exercises, to monitor and analyze data related to the performed exercise.

In the following, the description will be directed to gymnastic machines for pectoral muscles, triceps and deltoids, but it is clear that the same should not be considered limited to these specific uses.

As is well known, at present for carrying out exercises for training the strength of the pectoral muscles, triceps and deltoids, a user employs a machine known as a chest press, of the type comprising a stationary base and at least one part movable with respect to said base, mutually coupled by a junction or a pin.

The moving part typically has also a handle for the user so that the latter can lift up a weight, typically disc-shaped, loaded on a load bar fixed to the mobile part.

During the exercise, the user moves the movable part from a first position, wherein the movable part is resting on the stationary base, to a second position, wherein the movable part is arranged in a distal position relative to the stationary base.

The resistance opposed by the movable part and from the disk to the displacement by the user, allows the user to train a specific muscle district, in particular the pectoral, triceps and deltoids muscles.

Current strength gymnastic machines do not allow to acquire and then process activity data.

Usually the data, such as the weight of the disc or discs loaded on the mobile part, the number of repetitions performed by the user, the duration of the exercise, and the like are manually annotated by the user himself or by an assistant.

This procedure is often unsuitable for the user, both in terms of time spent for the manual acquisition and in terms of tools sizes needed for the user to record the data manually.

Also, manually scanned data are not processed automatically. In general, they are analyzed by competent personnel, who makes a subjective valuation.

The patent application US2014/0256516 is part of the prior art on gymnastic machines equipped with data acquisition systems.

SUMMARY OF THE INVENTION

In the light of the above, it is an object of the present invention to provide a strength training gymnastic machine for specific muscle districts that allows the acquisition and the following automatic data processing of a gymnastic exercise performed on the machine itself.

A further object of the present invention is to provide a system, applicable to a strength training gymnastic machine, so as to acquire and subsequently process data relating to a gymnastic exercise and its operating method.

It is also an object of the present invention obtaining a weight detection associated with the machine and in combination a detection of the displacement in the space of the user-selected weights.

It is therefore specific object of the present invention a gymnastic machine for carrying out strength exercises by a user comprising a support frame, at least one arm, movable with respect to said support frame, to carry out a gymnastic exercise by said user, wherein said at least one arm comprises a first end, rotatably coupled with said support frame, and wherein on said at least one arm a plurality of weights can be removably applied, at least one detecting system for detecting the displacement of said at least one arm with respect to said support frame, comprising at least one magnetic element, at least one magnetic sensor, for detecting the magnetic field generated by said magnetic element, capable of generating an electric signal related to said detected magnetic field, and a control logic unit, operatively connected to said magnetic sensor, for acquiring and processing said electric signal related to said detected magnetic field, said machine being characterized in that it comprises at least one elastic element interposed between said arm and said support frame, and in that said arm is capable of assuming: a rest position; a loading position, wherein at least one weight is loaded on said arm, thus causing a compression of said elastic element and a following longitudinal deformation $\Delta x$ of the same; and an operating position, wherein said arm is operated by said user during the execution of the gymnastic exercise and it is rotated with respect to said support frame; and in that said logic control unit is configured for determining the weights loaded on said at least one arm by the detection of the compression of said elastic element and of said following longitudinal deformation $\Delta x$.

Always according to the invention, said at least one arm may be rotatably coupled with said support frame by means of a rotation pin, and said at least one detecting system may be positioned in correspondence of said rotation pin.

Still according to the invention, said at least one magnetic sensor may be fixed to said support frame and said at least one magnetic element may be fixed to said rotation pin.

Advantageously according to the invention, said at least one magnetic sensor may be a Hall effect sensor.

Further according to the invention, said at least one magnetic sensor may measure the variation of the magnetic field generated by said at least one magnetic element while passing from said rest position to said loading position and/or during the execution of the gymnastic exercise, when said arm is in the operating position.

Preferably, according to the invention, in said in rest position, said arm may be arranged in contact with said elastic element.

Always according to the invention, said elastic element may be a spring or the like.

Still according to the invention, said machine may comprise a first and a second movable arm, and it may comprise a first detecting system to detect the displacement of said first arm, movable with respect to said support frame, and a second detecting system to detect the displacement of said second arm, movable with respect to said support frame.

Advantageously according to the invention, said control logic unit may be configured for determining the final weight loaded on said at least one arm when said detecting system: detects the first displacement of the weight in the space due to the movement of said arm; and/or the detection for a predefined time interval of non-variation of the loaded weight.

It is also object of the present invention a detecting system, intended to be coupled to a gymnastic machine for carrying out strength exercises by a user, characterized in that it comprises at least one magnetic element, at least one magnetic sensor, for detecting the magnetic field generated by said magnetic element, capable of generating an electric signal related to said detected magnetic field, and a control logic unit, operatively connected to said at least one magnetic sensor, for acquiring and processing said electric signal related to said detected magnetic field.

It is further object of the present invention an operating method of a gymnastic machine comprising the following steps: providing a support frame; providing at least one arm, movable with respect to said support frame, to carry out a gymnastic exercise by an user, on said arm can be loaded at least one weight, said at least one arm being capable of assuming a rest position and a loading position, wherein said at least one weight is loaded on said arm, thus causing a displacement of said arm; providing at least one detecting system, for the acquisition and processing of data, arranged on said gymnastic machine, characterized in that it further comprises the following step: a. acquiring data related to the displacement of said at least one arm in said loading step, by said at least one weight, of said gymnastic machine.

Always according to the invention, said method may further comprise the step of determining the final weight loaded on said at least one arm by: the detection of the first displacement of the weight in the space due to the movement of said arm; and/or the detection for a predefined time interval of non-variation of the loaded weight.

Still according to the invention, said method may comprise the further steps of providing at least one elastic element, such as a spring and the like, relative to a respective arm, interposed between said support frame and said arm, such that, in said loading position said arm causes a compression of said elastic element, and detecting the deformation undergone by said spring in said loading position, so as to determine the measure of said weight.

Advantageously according to the invention, said at least one arm may be is capable of further assuming an operating position, wherein it is operated by said user during the carrying of a gymnastic exercise and it is rotated, with respect to said support frame, and in that it comprises the following step: b. detecting data related to the displacement of said at least one arm by said user, with respect to said support frame.

Further according to the invention, said method may comprise the following step: c. processing said data, acquired in said steps a and b, for calculating the power related to the exercise carried out.

Preferably according to the invention, said step c. may comprise the following sub-steps: c.1 converting the data of the angle of rotation of said arm in a vertical displacement of said loaded weight; c.2 calculating the first derivative of said displacement to obtain the value of the vertical speed of said arm; c.3 calculating the second derivative of the displacement to obtain the value of the vertical acceleration of said arm; c.4 calculating the resultant force on said loaded weight; c.5 calculating the instant power; c.6 calculating the average of the instant power of a repetition to obtain the value of the mean power related to the gymnastic exercise carried out.

BRIEF DESCRIPTION OF THE SEVERAL VIEWS OF THE DRAWINGS

The present invention will be now described, for illustrative but not imitative purposes, according to its preferred embodiments, with particular reference to the figures of the enclosed drawings, wherein.

In the various figures, similar parts will be indicated by the same reference numbers.

DESCRIPTION OF SPECIFIC EMBODIMENTS OF THE INVENTION

Figure 1:
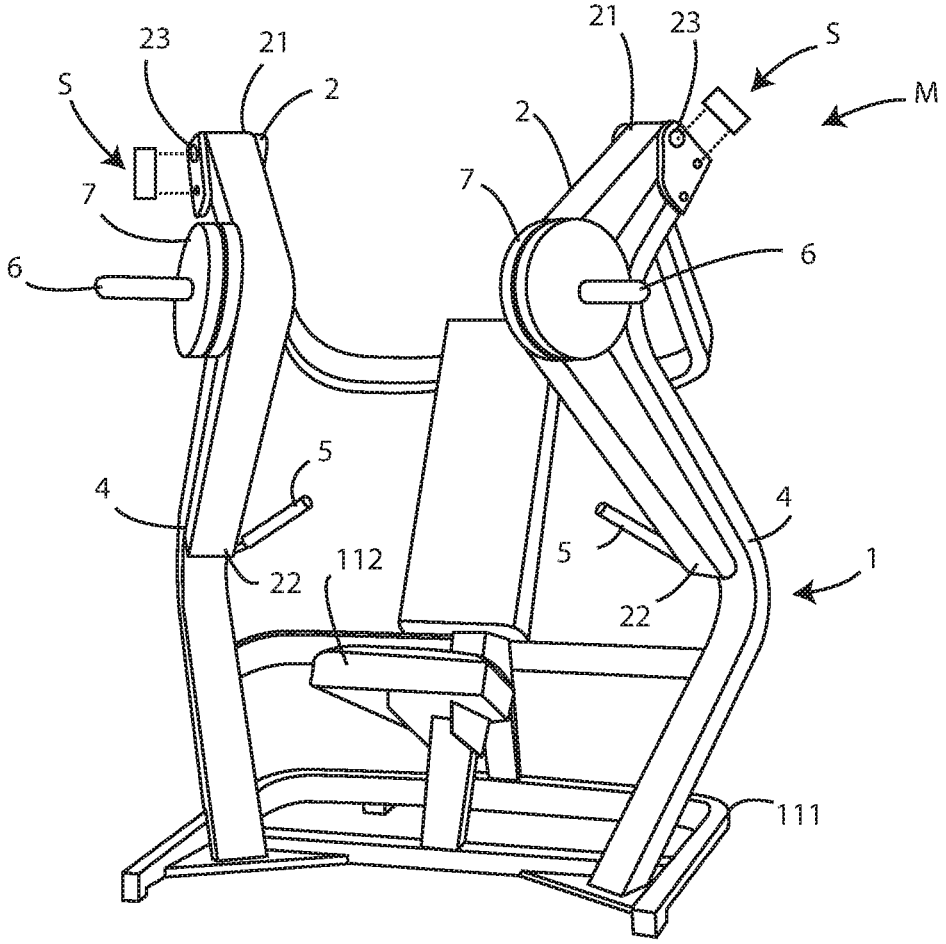
FIG. 1 shows a side perspective view of the gymnastic machine, covered with a cover casing, object of the present invention.
Figure 2:
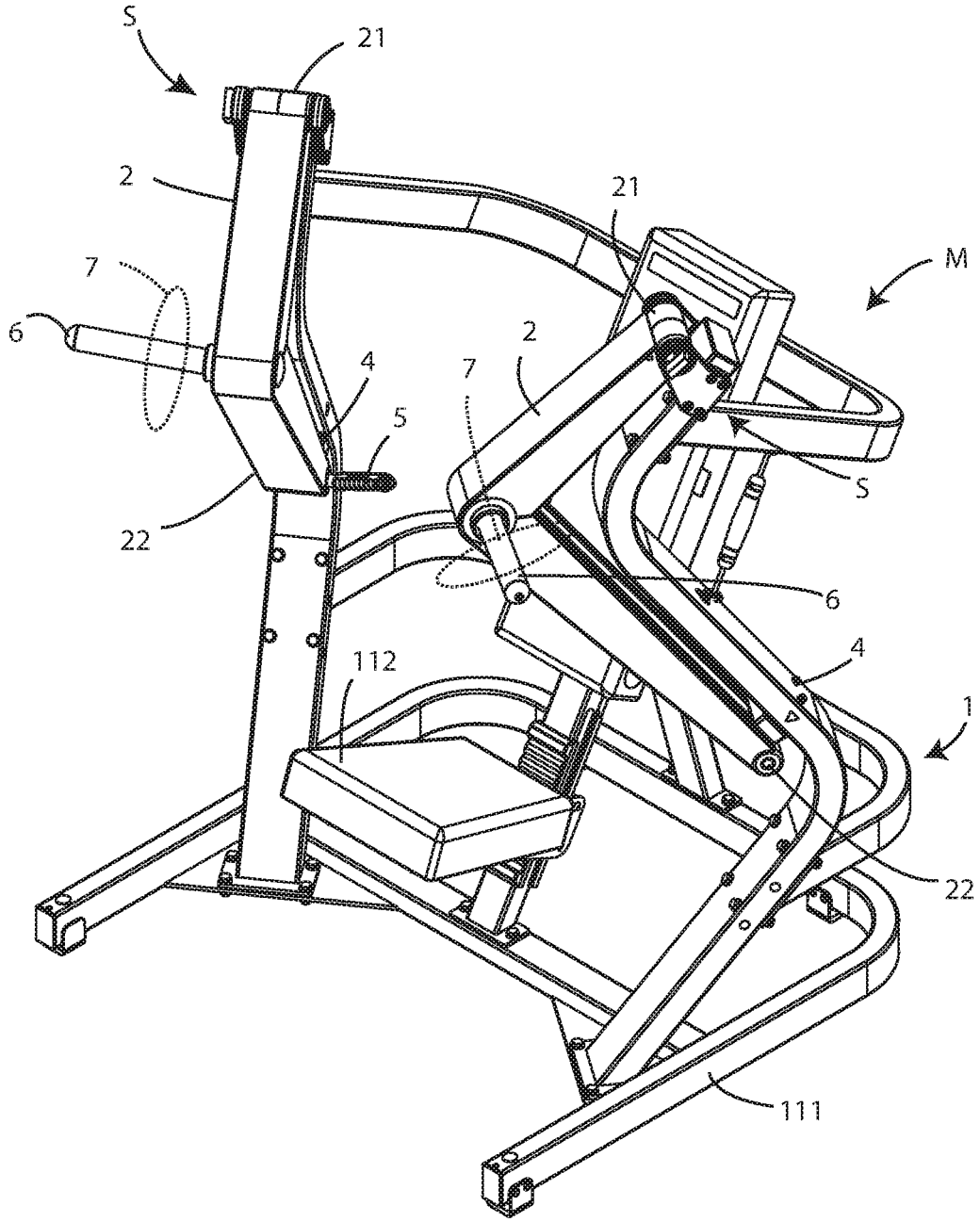
FIG. 2 shows a side perspective view of the exercise machine of FIG. 1 without a cover casing.
Figure 3:
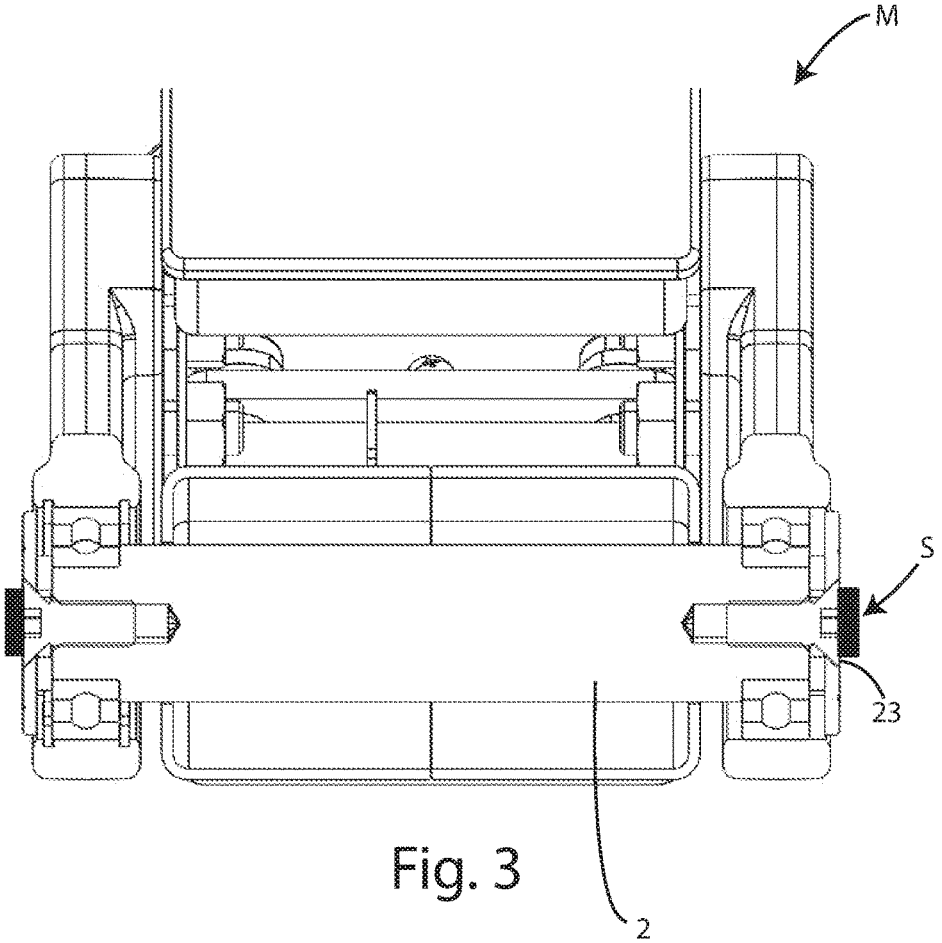
FIG. 3 is a cross-sectional view of a detail of the exercise machine of the present invention.
Figure 4:
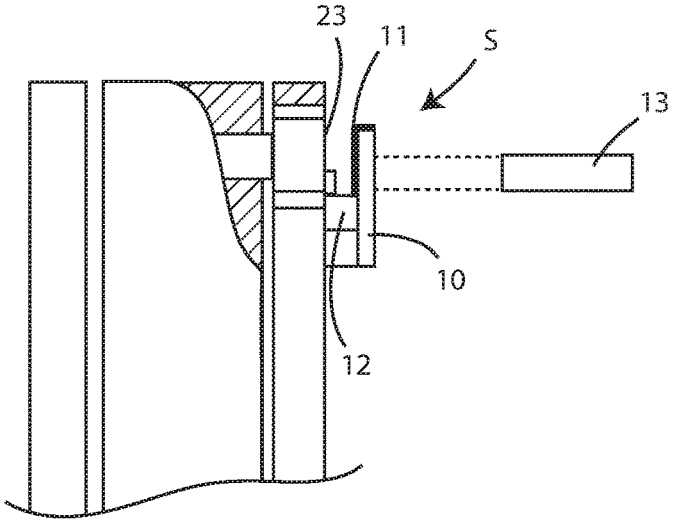
FIG. 4 shows a schematic frontal view in partial section of a detail of the exercise machine and the system of the present invention.

Referring to FIGS. 1-6, an exercise machine M of the present invention is shown, of the chest presses type, for training the pectoral muscles, triceps and deltoids.

Said gymnastic machine M comprises essentially a support frame 1, a pair of movable arms 2, rotatably coupled with said support frame 1, and a detection system S, installed on said support frame 1, for detecting data of the exercise that is performed by a user on the gymnastic machine M.

Said support frame 1 of said gymnastic machine M comprises a base 111 and a seat 112, on which the user can seat to perform the exercise.

The gymnastic machine M also comprises a first and a second spring indicated both with numeral reference 3, fixed to said support frame 1, which operation will be better described below.

Alternatively, each of said first and second spring 3 can be fixed to a respective arm 2, provided that, in each case, said spring 3 is interposed between the movable arm 2 and the support frame 1.

The gymnastic machine M also comprises a first and a second buffer 4 for protecting said support frame 1 when a user suddenly releases said pair of arms 2. These pads 4 prevent any collision of each one of said pair of arms 2 upon said support frame 1.

Each of said pair of arms 2 has a first 21 and a second 22 end. The first end 21 of each arm 2 is rotatably coupled with said support frame 1 by means of a respective rotation pin 23.

In the embodiment of the present invention, said rotation pin 23 is integral with said arm 2 and rotates solidly with it when the latter is moved by the user during the gymnastic exercise.

On said second end 22 a handle 5 is fixed that the user holds for carrying the gymnastic exercise.

On each of said pair of arms 2 a loading pin (or bar) 6 is fixed, upon which the user can insert at least one weight 7 for performing the gymnastic exercise.

Generally, the sizes of this weight 7 are as follows: 1.25 kg, 2.50 kg, 5.00 kg, 10.00 kg and 20.00 kg and on the loading pin 6 can be loaded at the same time five weights of different or equal sizes. Of course, the size of these weights is purely indicative.

In an alternative embodiment, each of the pair of arms 2 may be provided with a plurality of load pins 6 for loading a greater number of weights 7.

Said detection system S comprises a support bracket 10, a displacement sensor 11, a magnetic element 12, and a logic control unit 13.

In particular, said support bracket 10 is fixed to said support frame 1, near said rotation pin 23.

The magnetic element 12 is fixed to said rotation pin 23, so that it solidly rotates thereon during the gymnastic exercise.

Said displacement sensor 11 is a Hall effect sensor. It is used to detect both the displacement of the respective arm of said pair of arms 2 during the loading phase of said weight 7 by the user, and the displacement velocity of the respective arm of said pair of arms 2 during the execution of the gymnastics exercise.

In particular, said sensor 11 detects the variation of the magnetic field flux caused by the magnetic element 12, when the latter approaches and moves away from, or changes its position in the space with respect to said sensor 11. In fact, as a result of the variation of the magnetic field caused by said magnetic element 12, for the Hall effect, an electric current variation, suitably amplified, filtered and processed, is induced on the sensor 11 so as to detect the displacement in the space of said magnetic element 12 and detecting, consequently, the displacement of the respective arm 2 and the weight associated therewith.

As said, this detection occurs both during the loading step of said weight 7 and during the execution of the gymnastic exercise step, as it will be described in detail later.

In particular, said sensor 11 measures the voltage value caused by the above-mentioned current variation, as said caused by the magnetic field of said magnetic element 12, which is function of the rotation angle of each of said pair of arms 2 with respect to said support frame 1.

Said control logic unit 13 is operably connected to said sensor 11 and is capable of receiving as input the voltage data detected by said sensor 11 and providing as output, according to a predetermined data processing algorithm, the values of load, amplitude and velocity of movement of each of said pair of arms 2, frequency or repetitions of the gymnastic exercise and the power, as a function of the time, developed by the user, during the gymnastic exercise.

Said control logic unit 13 comprises a memory unit $U_M$, for storing data received from said sensor 11 and the parameters relating to the geometric characteristics of said machine M and of said spring 3, a calculation unit $U_c$, for processing the data stored in said memory unit $U_M$, and a unit $U_T$ for transferring the data processed.

Said control logic unit 13 may also comprise an interface unit $U_I$ with the user, whereby the user can set the characteristic parameters such as weight, height and the like and/or data relating to the type of gymnastic exercise to be carried out and can display the data processed by said logic control unit 13.

Said interface unit $U_I$ is fixed to said gymnastic machine interface on an arm of said pair of arms 2.

Said interface unit $U_I$ may also be arranged externally of said gymnastic machine M and communicate wirelessly or Bluetooth with said control logic unit 13.

In addition or alternatively to said interface unit $U_I$, said control logic unit 13 can exchange data with an external device available to the user, such as a smartphone or a wearable device and the like, by wireless or Bluetooth.

Alternatively, said control logic unit 13 can communicate directly with a cloud type remote system.

In addition, said control logic unit 13 also compares the data obtained from said arms 2 so as to compare the data relating to the exercise performed with the right limb and with the left limb.

This comparison can be carried out both on the data of each repetition, and on the average data calculated on the total of repetitions carried out, as said, with the right limb and the left limb.

In an alternative embodiment, the S systems can be fixed to a respective arm 2 at said first end 21 while the respective magnetic element 12 can be fixed to said support frame 1.

Figure 7:
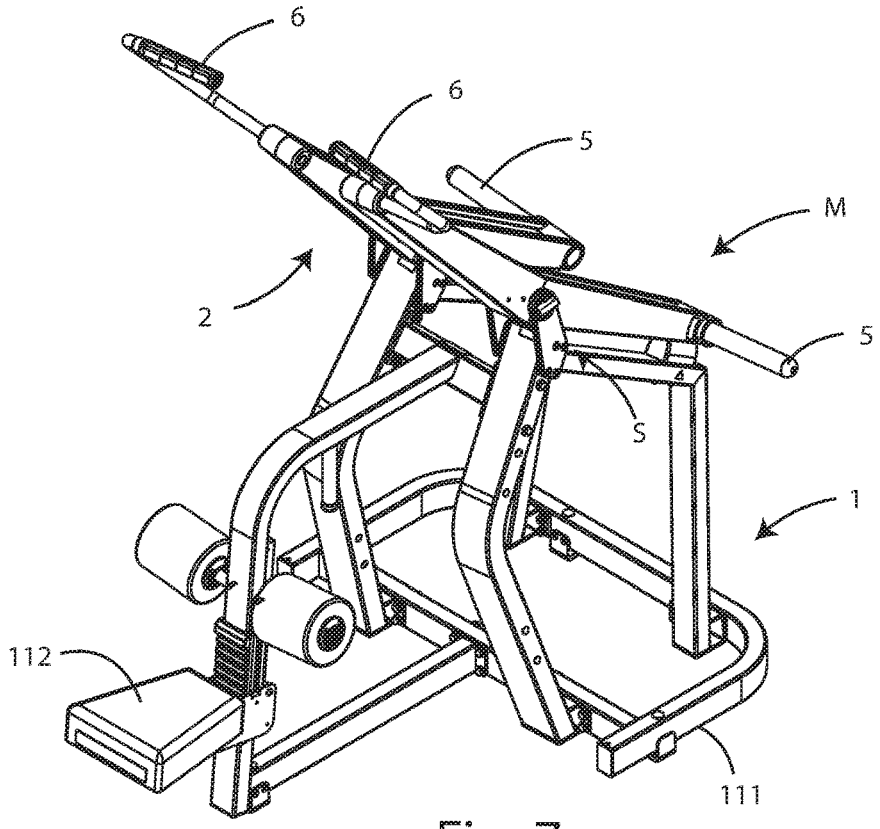
FIG. 7 shows a side perspective view of a second embodiment of the gymnastic machine of the present invention.

In FIG. 7 a second embodiment of the gymnastic machine M is shown, of pulldown type, for the workout of the dorsal muscles and biceps, and it also essentially comprises a support frame 1, a pair of arms 2, rotatably coupled with said support frame 1, and a detection system S, fixed to said support frame 1, for the recording of the data relating to the gymnastic exercises, which can be performed by said muscular gymnastic machine M.

Said support frame 1 of said gymnastic machine M comprises a base 111 and a seat 112, which the user can seat on to perform the exercise.

Figure 8:
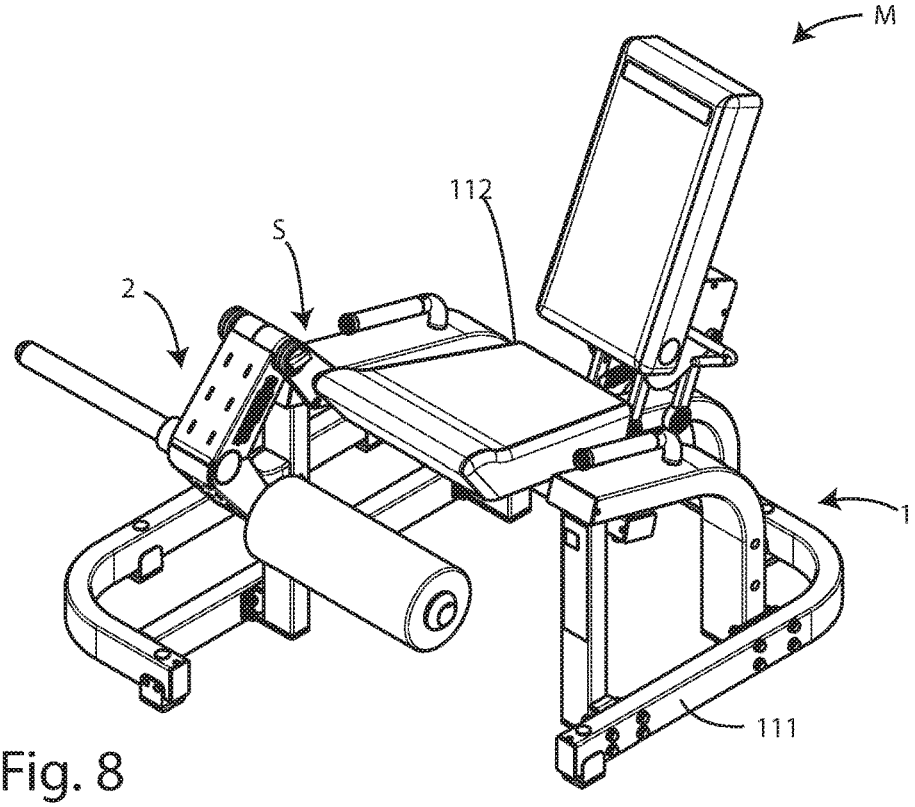
FIG. 8 shows a side perspective view of a third embodiment of the gymnastic machine of the present invention.
Figure 9:
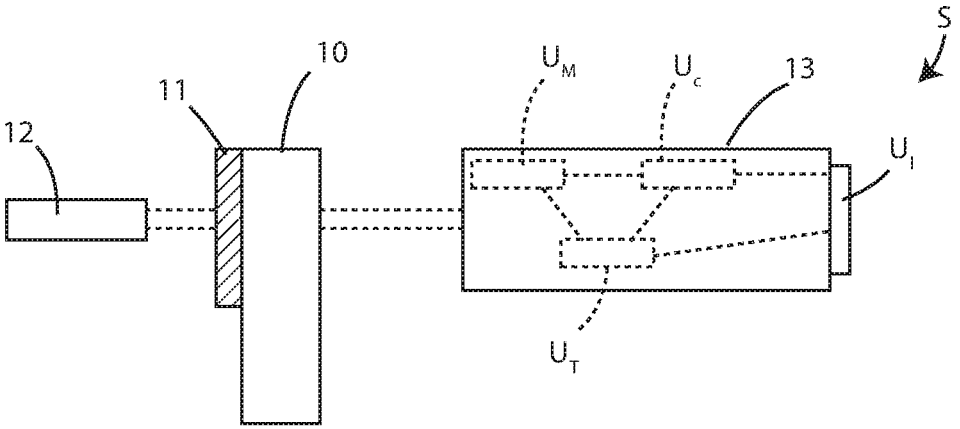
FIG. 9 shows a schematic view of the main components of the data detection system object of the present invention.
Figure 10:
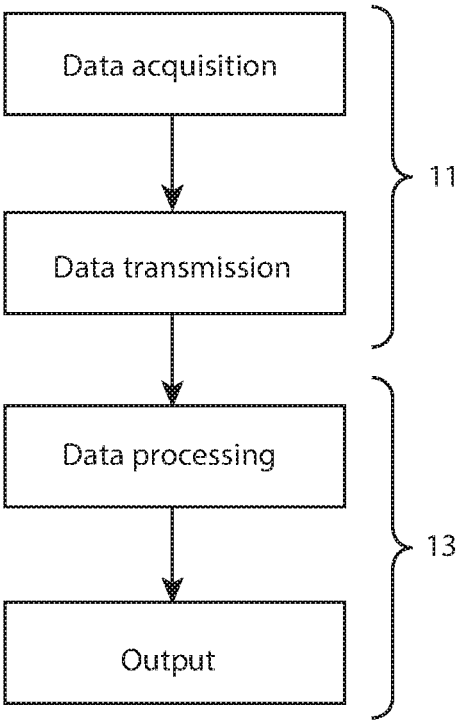
FIG. 10 shows a block diagram of the flowchart of the system of FIG. 9.

In FIG. 8 a third embodiment of the gymnastic machine M is shown, of the leg extension type for training the quadriceps muscles, which essentially comprises a support frame 1, an arm 2 rotatably coupled with said supporting frame 1, and a detection system S, fixed to said support frame 1.

Also in this case, said support frame 1 of said gymnastic machine M comprises a base 111 and a seat 112.

The operation of said gymnastic machine M and said detection system S is as follows.

If said gymnastic machine M is provided with said interface unit $U_I$, the user who has to carry out a gymnastic exercise sets the required data by said interface unit $U_I$, through which, the user also watches the data acquired during the year.

If, however, said gymnastic machine M is not provided with said interface $U_I$, he can identify himself and enter the data of the year by means of his own external device or by known methods based on wireless technology, RFID or Bluetooth.

In the general operation of the machine M there are an initial loading step of at least one weight 7 on the loading pin 6, and an operating step of the gymnastic exercise, in which the user rotates each arm 2 around said rotation pin 23.

Figure 5:
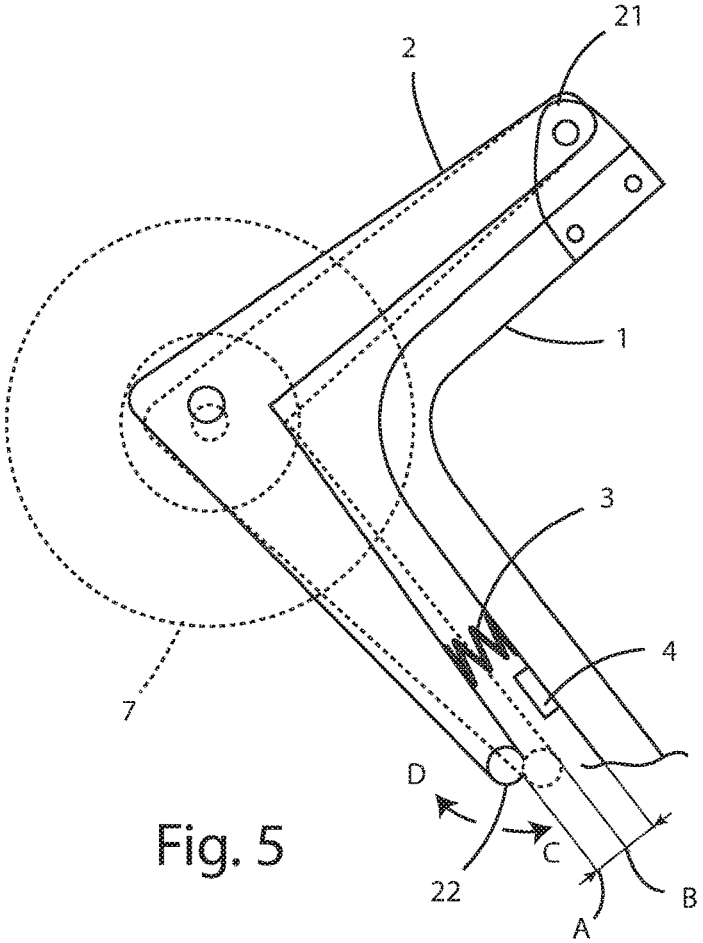
FIG. 5 shows a side schematic view of an arm in a rest position without load and in a loaded position.
Figure 6:
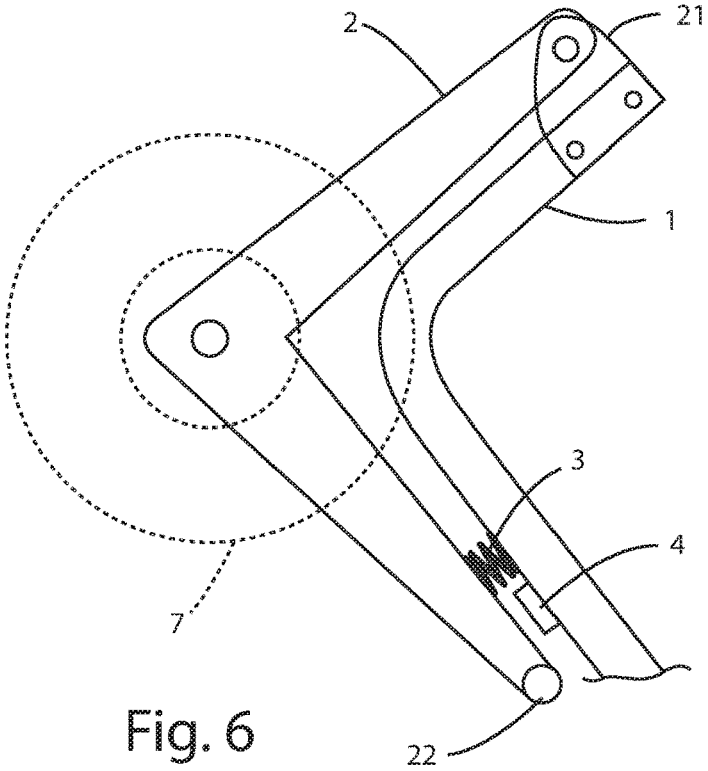
FIG. 6 shows a schematic side view of an arm of the gymnastic machine according to FIG. 5.

Referring particularly to FIG. 5, before each weight is inserted into the loading pin 6, each arm 2 is resting on said spring 3 and it is in a rest position, indicated in the figures with the letter A.

When the user loads at least one weight 7, said arm 2 rotates a few degrees according to the rotation direction C, the arm 2 rotates of an angle indicated by $\Delta\phi$, toward said support frame 1, compressing said spring 3 of an amount indicated by $\Delta x$, as a longitudinal deformation. Said arm 2 is thus in the loading position, indicated in the figures with the letter B. The deformation undergone by said spring 3, indicated as said with $\Delta x$, is proportional to the loaded weight 7. Therefore, for the measurement of said weight 7 the deformation of said spring 3 is evaluated, in its turn proportional to the rotation angle of said arm 2 with respect to the rest position of each arm 2.

The rotation of said arm 2 is, as said, proportional to the deformation of said spring 3, also displaces said magnetic element 12 into the space, which therefore causes a magnetic field variation that is detected by said sensor 11.

The loading step has a variable duration, which depends on the number of weights 7 that the user charges on the loading pin 6. In other words, in practical terms, when a user loads the machine M, the total weight 7 loaded on each arm 2 could be made of several weights, which are usually discs. Of course, during the loading step, while the weights 7 of an arm 2 are inserted into the respective load pin 6, the load momentarily detected by the detection system S varies over time.

The final load placed on the arms 2, with which the user actually performs the exercises and on basis of which the power performance calculations are performed (as better described below), is detected when the detection system S detects the first displacement of the weight 7 itself in the space, due to the moving of the arm 2, or, alternatively, when the detection system S detects that the load of the weights 7 does not vary for a predetermined time interval.

For each loaded weight 7, said detection system S performs the detection of the data described above.

After the loading step is complete, therefore, the gymnastic machine M is capable of acquiring and detecting independently the weight 7 loaded on each arm 2, before the user begins the exercises. In the following operating step of carrying out the gymnastic exercise, the user grasps said handle 5 and moves said arm 2, which rotates according to the rotation direction D, then moving away from said support frame 1.

During the rotation of said arm 2 and consequently of said rotation pin 23, also said magnetic element 12 rotates, thus causing a variation of the magnetic field generated by said sensor 11.

Said sensor 11 thus detects the variations of said magnetic field, in particular measuring the voltage value relative to the rotation angle of said arm 2.

Said data detected by said sensor 11 are sent to said logic control unit 13, which performs the following operations:

- it acquires the data related to the time trend of the rotation angle $\phi$;
- it converts the rotation angle $\phi$ data in the vertical displacement of said loaded weight 7;
- it carries out the calculation of the first derivative of said displacement to obtain the value of the vertical velocity of said arm 2;
- it carries out the calculation of the second derivative of said displacement to obtain the vertical acceleration value of said arm 2;
- it carries out the calculation of the resulting force on the loaded weight 7;
- it carries out the calculation of the instantaneous power and finally it calculates the average instantaneous power on a repetition to obtain the average power value for the performed exercise.

In other words, by using the above procedure the power developed by the user during the gymnastic exercise can be calculated.

As can be seen from the present invention, the gymnastic machine M allows to automatically acquire and process data relating to gymnastic exercise performed by a user.

Specifically, the detection system S is simple to install on the gymnastic machine M when it comprises a single sensor for detecting arm displacement both during the loading step and during the operating step during the gymnastic exercise.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A gymnastic machine (M) for carrying out strength exercises by a user, comprising:

a support frame (1), at least one arm (2), movable with respect to said support frame (1), to carry out a gymnastic exercise by said user, wherein said at least one arm (2) comprises a first end (21), rotatably coupled with said support frame (1), and wherein on said at least one arm (2) a plurality of weights (7) can be removably applied, wherein said at least one arm (2) is capable of assuming a rest position, a loading position, wherein at least one weight (7) is loaded on said at least one arm (2), and an operating position, wherein said at least one arm (2) is operated by said user during the execution of the gymnastic exercise and it is rotated with respect to said support frame (1), at least one detecting system (S) for detecting a displacement of said at least one arm (2) with respect to said support frame (1), comprising at least one magnetic element (12), at least one magnetic sensor (11), for detecting a magnetic field generated by said magnetic element (12), capable of generating an electric signal related to said detected magnetic field, and a logic control unit (13), operatively connected to said magnetic sensor (11), for acquiring and processing said electric signal related to said detected magnetic field, wherein the gymnastic machine (M) comprises at least one elastic element (3) interposed between said at least one arm (2) and said support frame (1), wherein in said rest position, said at least one arm (2) is arranged in contact with said at least one elastic element (3) and in said loading position, said at least one weight (7) loaded on said at least one arm (2) causes a compression of said at least one elastic element (3) and a following longitudinal deformation $\Delta x$ of the same; and wherein said logic control unit (13) is configured for determining weights (7) loaded on said at least one arm (2) by the detection of the compression of said at least one elastic element (3) and of said following longitudinal deformation $\Delta x$; and wherein said at least one magnetic sensor (11) measures a variation of the magnetic field generated by said at least one magnetic element (12) while passing from said rest position to said loading position and during the execution of the gymnastic exercise, when said at least one arm (2) is in the operating position.

2. The gymnastic machine (M) according to claim 1, wherein said at least one arm (2) is rotatably coupled with said support frame (1) by a rotation pin (23), and wherein said at least one detecting system (S) is positioned in correspondence of said rotation pin (23).

3. The gymnastic machine (M) according to claim 1, wherein said at least one magnetic sensor (11) is fixed to said support frame (1) and said at least one magnetic element (12) is fixed to a rotation pin (23).

4. The gymnastic machine (M) according to claim 1, wherein said at least one magnetic sensor (11) is a Hall effect sensor.

5. The gymnastic machine (M) according to claim 1, wherein said at least one elastic element (3) is a spring.

6. The gymnastic machine (M) according to claim 1, wherein said at least one arm of the gymnastic machine (M) comprises a first and a second (2) movable arm, and wherein said at least one detecting system of the gymnastic machine (M) comprises a first detecting system (S) to detect the displacement of said first arm (2), movable with respect to said support frame (1), and a second detecting system (S) to detect the displacement of said second arm (2), movable with respect to said support frame (1).

7. The gymnastic machine (M) according to claim 1, wherein said logic control unit (13) is configured for determining a final weight (7) loaded on said at least one arm (2) when said detecting system (S):

detects a first displacement of the at least one weight (7) in the space due to the movement of said at least one arm (2); and/or detects for a predefined time interval a non-variation of the loaded weight (7).

8. The gymnastic machine (M) according to claim 1, wherein, in the rest position, either a first end of said at least one elastic element (3) is fixated to said support frame (1) and a second end of said at least one elastic element is in contact with said at least one arm (2), or the first end of said at least one elastic element (3) is in contact with said support frame (1) and the second end of said at least one elastic element (3) is fixated to said at least one arm (2).

9. The gymnastic machine (M) according to claim 1, wherein said logic control unit (13) is configured to determine the longitudinal deformation Δx based on measurement by the at least one magnetic sensor (11) of the variation of the magnetic field generated by the at least one magnetic element (12) while passing from said rest position to said loading position.

10. A method of a gymnastic machine (M), comprising:

providing the gymnastic machine (M), wherein the gymnastic machine (M) comprises:

a support frame (1), at least one arm (2), movable with respect to said support frame (1), to carry out a gymnastic exercise by said user, wherein said at least one arm (2) comprises a first end (21), rotatably coupled with said support frame (1), and wherein on said at least one arm (2) a plurality of weights (7) can be removably applied, wherein said at least one arm (2) is capable of assuming a rest position, a loading position, wherein at least one weight (7) is loaded on said at least one arm (2), and an operating position, wherein said at least one arm (2) is operated by said user during the execution of the gymnastic exercise and it is rotated with respect to said support frame (1), at least one detecting system (S) for detecting a displacement of said at least one arm (2) with respect to said support frame (1), comprising at least one magnetic element (12), at least one magnetic sensor (11), for detecting a magnetic field generated by said magnetic element (12), capable of generating an electric signal related to said detected magnetic field, and a logic control unit (13), operatively connected to said magnetic sensor (11), for acquiring and processing said electric signal related to said detected magnetic field, wherein the gymnastic machine (M) comprises at least one elastic element (3) interposed between said at least one arm (2) and said support frame (1), wherein in said rest position, said at least one arm (2) is arranged in contact with said at least one elastic element (3) and in said loading position, said at least one weight (7) loaded on said at least one arm (2) causes a compression of said at least one elastic element (3) and a following longitudinal deformation Δx of the same; and wherein said logic control unit (13) is configured for determining weights (7) loaded on said at least one arm (2) by the detection of the compression of said at least one elastic element (3) and of said following longitudinal deformation Δx; and wherein said at least one magnetic sensor (11) measures a variation of the magnetic field generated by said at least one magnetic element (12) while passing from said rest position to said loading position and during the execution of the gymnastic exercise, when said at least one arm (2) is in the operating position, loading said at least one weight (7) on said at least one arm (2), thus causing the displacement of said at least one arm (2); and a. acquiring, with the at least one detecting system (S), data related to the displacement of said at least one arm (2) in said loading step, by said at least one weight (7), of said gymnastic machine (M).

11. The method according to claim 10, further comprising the following step:

b. detecting data related to the displacement of said at least one arm (2) by said user, with respect to said support frame (1).

12. The method according to claim 11, further comprising:

c. processing said data, acquired in said steps a and b, for calculating power related to the gymnastic exercise carried out.

13. The method according to claim 12, wherein said processing said data comprises the following sub-steps:

c.1 converting data of an angle of rotation of said at least one arm in a vertical displacement of said loaded weight;

c.2 calculating a first derivative of said displacement to obtain a value of a vertical speed of said at least one arm;

c.3 calculating a second derivative of the displacement to obtain a value of a vertical acceleration of said at least one arm;

c.4 calculating a resultant force on said loaded weight;

c.5 calculating an instant power;

c.6 calculating an average of the instant power of a repetition to obtain a value of a mean power related to the gymnastic exercise carried out.

14. The method according to claim 10, further comprising determining a final weight (7) loaded on said at least one arm (2) by:

detection of a first displacement of the at least one weight (7) in the space due to the movement of said at least one arm (2); and/or detection for a predefined time interval of a non-variation of the loaded weight (7).

15. The method according to claim 10, further comprising:

detecting the longitudinal deformation $\Delta x$ undergone said at least one elastic element (3) in said loading position, so as to determine the weights loaded.

* * * * *